US005956810A

United States Patent [19]

Spaeth

[11] Patent Number: 5,956,810

[45] Date of Patent: Sep. 28, 1999

[54] FOLDABLE SEAT HINGE

[75] Inventor: Kenneth A. Spaeth, Two Rivers, Wis.

[73] Assignee: Estran Corporation, Two Rivers, Wis.

[21] Appl. No.: 09/075,021

[22] Filed: May 8, 1998

[51] Int. Cl.[6] ..... E05D 11/06

[52] U.S. Cl. ..... 16/358; 297/376

[58] Field of Search ..... 16/358, 359, 360, 16/357, 361; 297/376, 378.1

[56] References Cited

U.S. PATENT DOCUMENTS

| | | | |
|---|---|---|---|
| 3,065,498 | 11/1962 | Johnson | 16/358 |
| 3,233,927 | 2/1966 | Ammon | 16/358 |
| 3,740,791 | 6/1973 | Bulin | 16/358 |
| 4,953,259 | 9/1990 | Frye et al. | 16/358 |
| 5,052,076 | 10/1991 | Spaeth . | |
| 5,172,969 | 12/1992 | Reuter et al. | 16/358 |
| 5,725,279 | 3/1998 | Ward et al. . | |

FOREIGN PATENT DOCUMENTS

| | | | |
|---|---|---|---|
| 625400 | 9/1961 | Italy | 16/357 |

*Primary Examiner*—Chuck Y. Mah
*Attorney, Agent, or Firm*—Ryan Kromholz & Manion, S.C.

[57] ABSTRACT

The present invention relates to the field of hinges, and specifically, to seat hinges of the type used for foldable boat seats. A hinge including two seat cushion supporting members and a back plate is taught. One supporting member has a pair of acruate channels formed about a central pivot through which fasteners pass. The arcuate channels are concealed between the other supporting member and back plate and limit the hinge between its fully closed and fully opened positions.

2 Claims, 4 Drawing Sheets

FOLDABLE SEAT HINGE

BACKGROUND OF THE INVENTION

The present invention relates to the field of hinges and, specifically, to seat hinges of the type used for foldable boat seats. Such seats commonly have a back that can fold down over the seat and are usually provided with a strap having a snap at the end to hold the seat in a folded position.

The hinge that is most commonly used is a pair of metal angles fastened together with a large rivet. One angle is bolted to the seat bottom and the other to the seat back so that the rivet serves as a pivot for the hinge. These metal hinges can pinch the fingers of the user if the user puts a hand between the parts of the hinge while the seat is being pushed upright.

Another hinge commonly used is made out of two pieces, molded from a resistant material, each having a hinge guide portion which surrounds the pivot point of each of the two pieces. The hinge guide portion has a form which is an arc drawn about the pivot point, the two arcs fitting closely with one another and never separating regardless of the orientation of the seat back. The various hinge positions always result in the two hinge guide portions overlapping one another without any gap; therefore not allowing a person to pinch her fingers in the process.

For example, U.S. Pat. No. 5,052,076 to Spaeth, discloses a seat back hinge in which the hinge pivot has a generally circular outer pivot wall on one section of the hinge, and a generally circular inner pivot wall on the other section of the hinge. The inner wall is of a size that allows it to fit closely inside the outer wall. The inner wall is provided with ears that project at right angles to the top of the inner wall and the outer wall is provided with relieved sections or bays that allow the ears to pass through the outer wall in only one orientation. Concentric shield portions keep fingers of an user out of the hinge. Integral stops limit movement and an integral leaf spring catches a detent to lock the hinge in one position.

Yet another prior art seat back hinge is made out of two sections coupled by means of a fastener and two plastic pins. The first section has one planar and circular end having a first aperture and two arcuate channels formed therein surrounding the first aperture. The second section has a corresponding planar and circular end parallel to the end of the first section. The second section end further includes three apertures disposed to be aligned with the first aperture and the two arcuate channels. The hinge further comprises a planar and circular intermediate plate, parallel and adjacently coupled to the first section end and the second section end. The intermediate plate has three intermediate apertures disposed to be aligned with the other apertures and the two arcuate channels. The hinge further comprises a planar and circular back plate, parallel and adjacently coupled to the first section end, opposite to the intermediate plate. The back plate has three back apertures disposed to be aligned with the other apertures and with the two arcuate channels. The intermediate plate and the back plate are made out of plastic. The single fastener is made out of steel and the pins are made out of plastic. The plastic pins are perpendicular to the ends of the two sections, the intermediate plate and the back plate and housed within the apertures and the arcuate channels. When pressure is applied to the seat back in its upright position, this type of hinge has the tendency to fail, therefore destroying the entire seat.

It is an object of the present invention to provide a seat hinge comprising three pieces and three fasteners, which require a simple assembly operation. It is a further object of this invention to provide a seat hinge which is formed from inexpensive materials. It is also an object of this invention to provide a seat hinge offering additional strength and improved reliability to the foldable boat seat.

SUMMARY OF THE INVENTION

The present invention is a seat hinge of the type used on boat seats, especially foldable boat seats. The object of the invention is to provide a hinge comprising two sections coupled together by means of a plurality of fasteners. The first section of the hinge has one substantially planar and circular end having a first aperture and two arcuate channels formed therein and surrounding the first aperture. The first aperture and the two arcuate channels are dimensioned to house the fasteners. The second section of the hinge has a corresponding substantially planar and circular end, parallel and adjacently coupled to the first section end. The second section end further comprises three second apertures axially disposed to be aligned with the first aperture and the two arcuate channels of the first section. The three second apertures are dimensioned to house the fasteners. The hinge further comprises a circular substantially planar back plate, parallel to the end of the first section and the end of the second section and adjacently coupled to the end of the first section. The back plate further comprises three back plate apertures, axially disposed to be aligned with the second apertures of the second section, the first aperture and the two arcuate channels of the first section.

In its preferred embodiment, the fasteners are limited to three, the number of existent apertures or channels in each section of the hinge. The fasteners, as well as the back plate, are made out of steel to provide improved strength, are substantially perpendicular to the two sections of the hinge and the back plate, and are housed within the apertures and arcuate channels of the two sections of the hinge and of the back plate. The fasteners have ends with an end diameter slightly larger than a diameter of the apertures and the arcuate channels of the two sections of the hinge and of the back plate.

Once the two sections are assembled by fastening the corresponding ends and the back plate, the hinge may be rotated about its pivot point having an axis defined by the first aperture, the corresponding fastener, and the corresponding second aperture and back plate aperture. The two fasteners housed within the two arcuate channels will travel from one end of the arcuate channels to the other. Therefore, the hinge may be moved from a position in which the hinge sections form the greatest angle to one another to a position where the angle formed is minimal.

DETAILED DESCRIPTION

Although the disclosure hereof is detailed and exact to enable those skilled in the art to practice the invention, the physical embodiments herein disclosed merely exemplify the invention which may be embodied in other specific structure. While the preferred embodiment has been described, the details may be changed without departing from the invention, which is defined by the claims.

Figure 1:
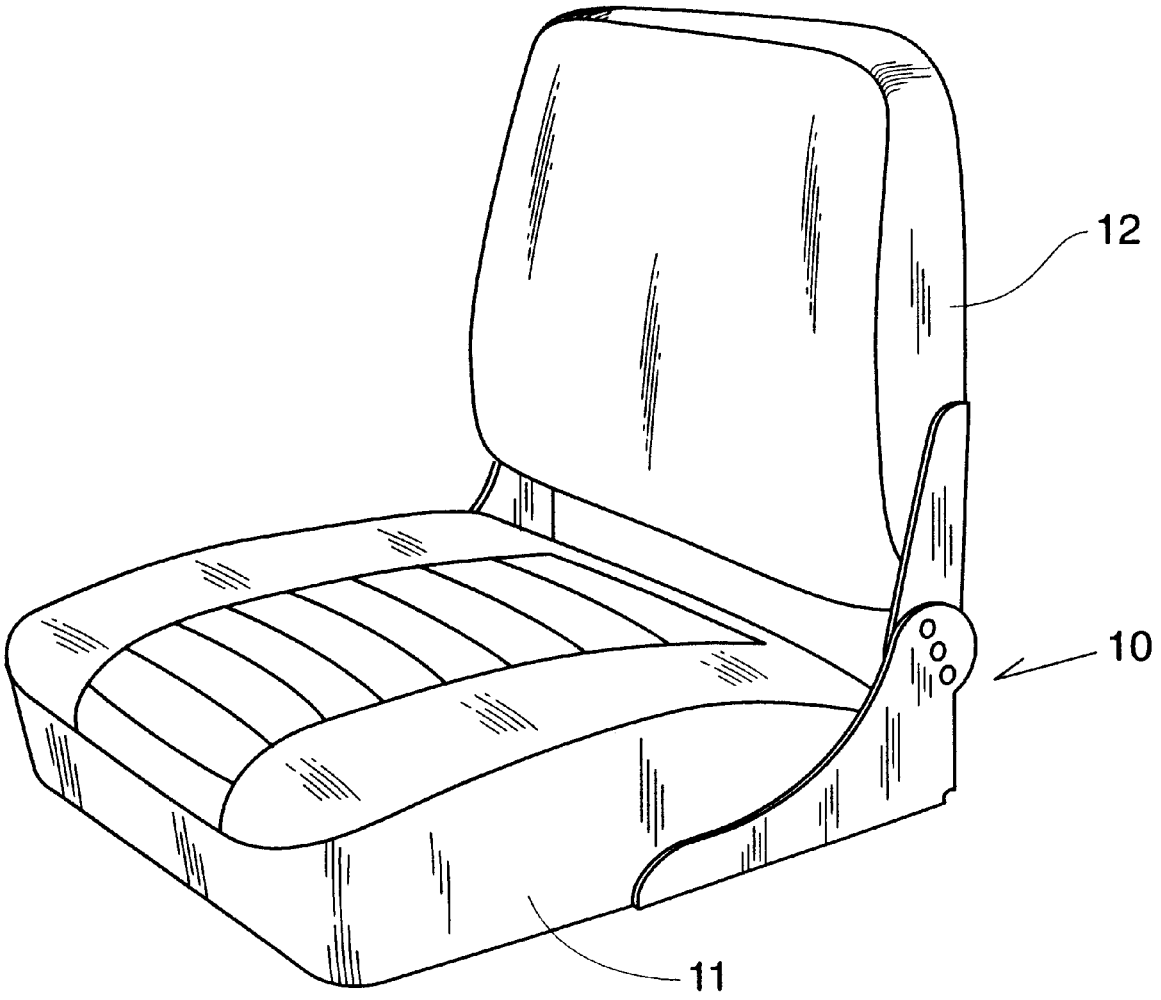
FIG. 1 is a perspective view of the seat hinge attached to a foldable boat seat.
Figure 2:
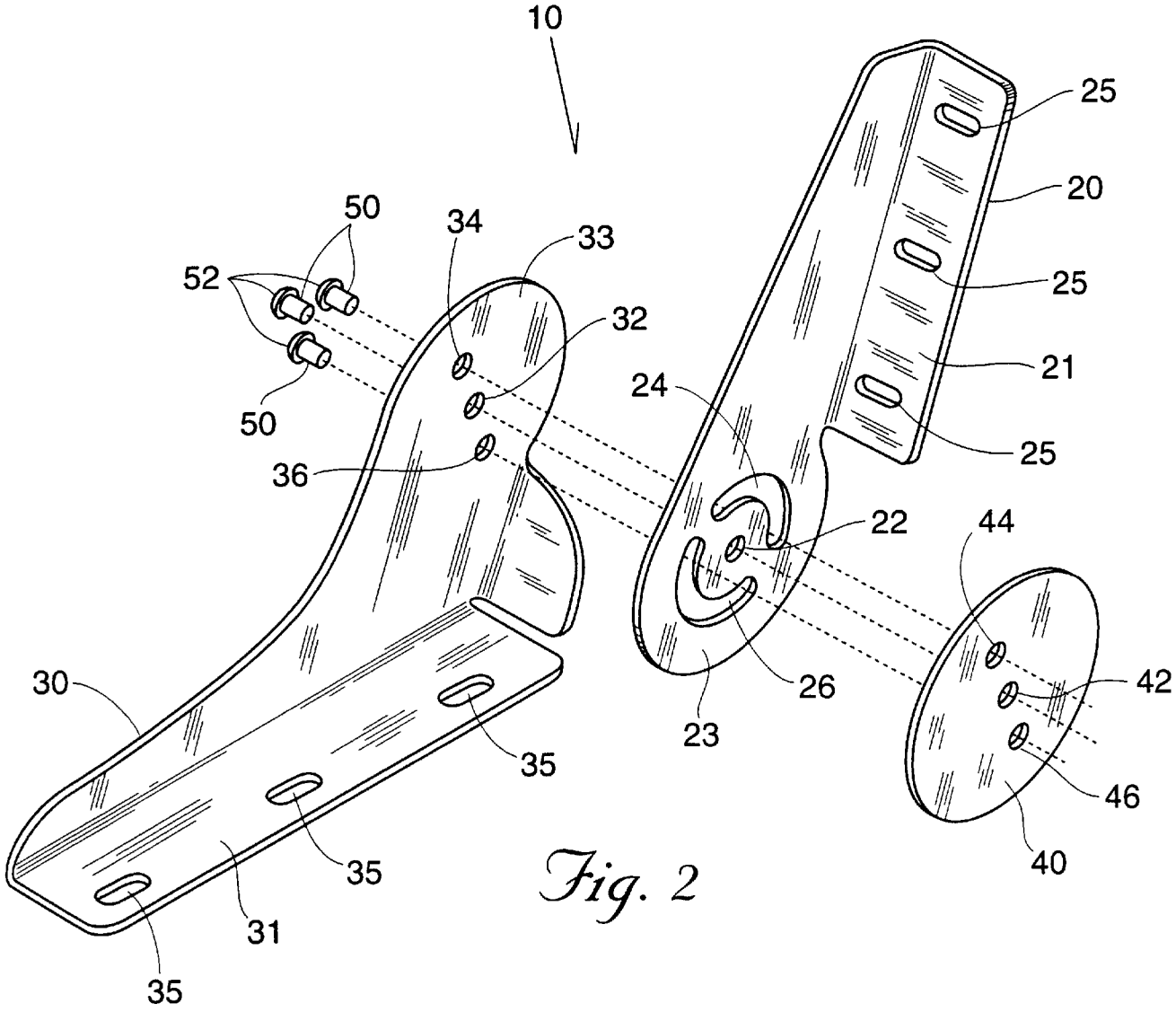
FIG. 2 is a perspective view of the seat hinge in an exploded condition.

Referring to FIGS. 1 and 2, the seat hinge is generally shown as 10. FIG. 1 shows the way the hinge 10 attaches to the seat bottom 11 and the seat back 12.

Referring to FIG. 2, the hinge 10 comprises a first section 20, a second section 30, and a back plate 40 coupled together using three fasteners 50. The first section 20 comprises an elongated L-shaped flange 21 and a substantially planar and circular end 23 having a first aperture 22 and a pair of arcuate channels 24, 26 formed therein about the aperture 22. The elongated L-shaped flange 21 has a plurality of elongated apertures 25 and attaches to the seat back 12 as shown in FIG. 1. The aperture 22 and the two arcuate channels 24, 26 have a diameter slightly larger than the diameter of the fasteners 50 and are dimensioned to house the fasteners 50.

As shown in FIG. 2, the second section 30 comprises an elongated L-shaped flange 31 and a substantially planar and circular end 33 having three axially disposed second apertures, 32, 34, and 36. The elongated L-shaped flange 31 has a plurality of elongated apertures 35 and attaches to the seat bottom 11 as shown in FIG. 1, while the end 33 is substantially parallel and adjacently pivotally coupled to the end 23 of the first section 20. The three apertures 32, 34, 36 have a diameter slightly larger then the diameter of the fasteners 50 and are dimensioned to house the fasteners 50. The three apertures 32, 34, 36 are disposed to allow aperture 32 to correspond with first aperture 22, and aperture 34 and 36 to correspond respectively with the arcuate channels 24 and 26.

Referring also to FIG. 2, a back plate 40 is also provided. The back plate 40 is substantially planar and circular, and is adjacently coupled and substantially parallel to the end 23 of the first section 20 so as to be situated opposite the end 33 of the second section 30. The back plate 40 includes three axially disposed back plate apertures 42, 44, 46. The three apertures 42, 44, 46 have a diameter slightly larger than the diameter of the fasteners 50 and are dimensioned to house the fasteners 50. The three back plate apertures 42, 44, 46 are disposed to allow aperture 42 to correspond with apertures 22 and 32, and apertures 44 and 46 to correspond respectively with apertures 34 and 36 and with the arcuate channels 24 and 26. The back plate 40 is preferably also made out of steel. The back plate 40 provides support to the first section 20 and the second section 30 of the hinge 10 and provides additional strength to the hinge 10. This additional strength is needed when pressure is exerted by the user on the seat back 12. Additional strength is also required when the seat bottom 11 and the seat back 12 are folded together because each cushion is somewhat compressed into the other.

In order to provide better shock resistance and avoid the possibility of failure, the fasteners 50 are also preferably made out of steel. The fasteners 50 have ends 52 with an end diameter slightly larger than the diameter of the first aperture 22, and arcuate channels 24, 26, the second apertures 32, 34, 36, and the back plate apertures 42, 44, 46, to provide tight and secure fastening. The ends of the fasteners 50 are deformed or swaged after assembly of the hinge 10.

Figure 3:
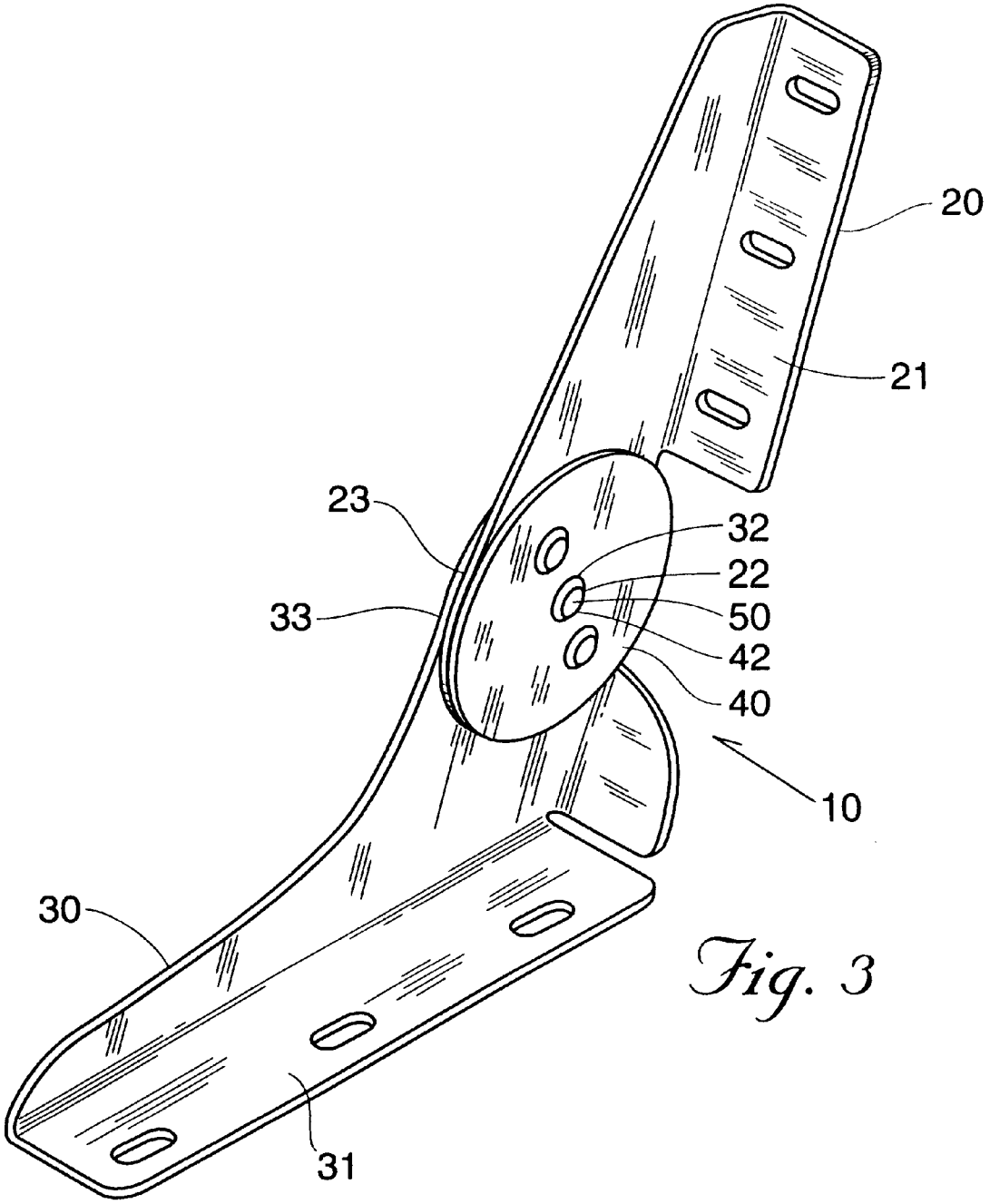
FIG. 3 is a perspective view of the seat hinge.
Figure 4:
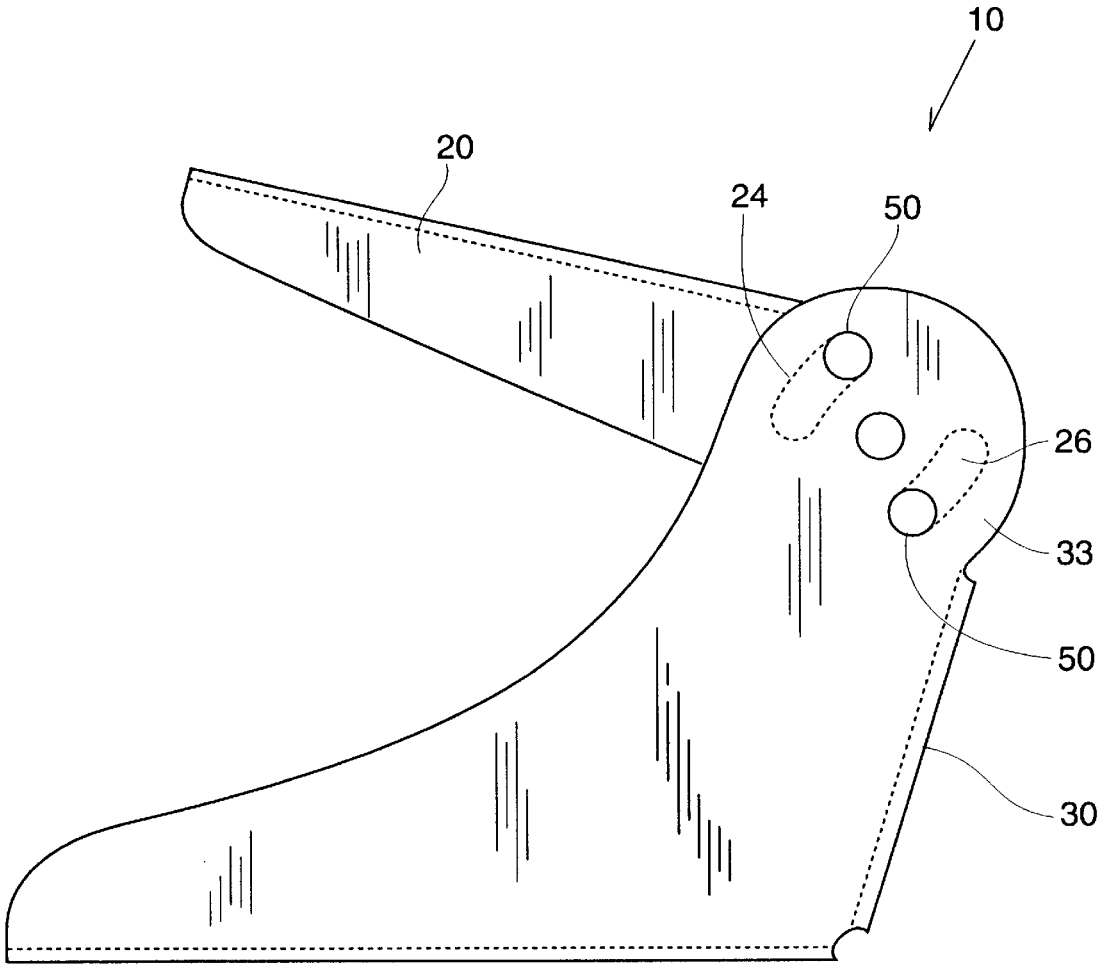
FIG. 4 is a side elevational view of the seat hinge, showing the relationship of the two sections of the seat hinge.

Referring to FIGS. 1, 3 and 4, once the two sections 20 and 30 are assembled by fastening the corresponding ends 23 and 33 and the back plate 40, the seat bottom 11 is bolted to the L-shaped flange 31 of the second section 30 and the seat back 12 is bolted to the L-shaped flange 21 of the first section 20. As shown in FIGS. 3 and 4, the assembled hinge 10 may be rotated about its pivot point having an axis defined by the fastener 50, the first aperture 22, the second aperture 32 and the back plate aperture 42. Referring now to FIG. 4, the two fasteners 50 housed within the two arcuate channels 24, 26 is shown in phantom lines, will only travel within those channels 24, 26. Therefore, the hinge 10 may be moved from a position in which the hinge sections 20 and 30 form the greatest angle to one another to a position where the angle formed is minimal.

The foregoing is considered as illustrative only of the principles of the invention. Furthermore, since numerous modifications and changes will readily occur to those skilled in the art, it is not desired to limit the invention to the exact construction and operation shown and described. While the preferred embodiment has been described, the details may be changed without departing from the invention, which is defined by the claims.

What is claimed is:

1. A hinge for a foldable seat comprising:

a first section;

a second section;

said first section having a first end and a second end;

said second section having a first end and a second end;

said second end of said first section and said first end of said second section being substantially planar and adjacently coupled to one another;

said second end of said first section having a first aperture and a pair of arcuate channels formed therein;

said first end of said second section having three coplanar second apertures, the plane of said second apertures being substantially perpendicular to the plane of said second section and respectively aligned with the respective axis of said first aperture and with the arcuate path of said channels;

a metallic back plate;

said back plate being substantially planar, parallel to said second end of said first section and to said first end of said second section and adjacently coupled to said second end of said first section;

said back plate having three coplanar back plate apertures, the plane of said back plate apertures being substantially perpendicular to said plane of said back plate and respectively aligned with each of the respective axes of said first aperture, said pair of arcuate channels, and said three second apertures;

three metallic fastener members; and said fastener members substantially perpendicular to said back plate, said second end of said first section, and said first end of said second section, and said fastener members being respectively positioned within said first aperture, said arcuate channels, said second apertures and said back plate apertures.

2. The hinge of claim 1, wherein said fasteners have ends with an end diameter slightly larger than a diameter of said first aperture, said second apertures, said back plate apertures and the width of said arcuate channels.

* * * * *